United States Patent [19]

DeZinno

[11] 3,955,681

[45] May 11, 1976

[54] ARTICLE RETAINER FOR STACKED ASSEMBLY

[75] Inventor: Theophile L. DeZinno, Miami, Fla.

[73] Assignee: Plastic Graphix Corporation, Miami, Fla.

[22] Filed: Mar. 3, 1975

[21] Appl. No.: 554,726

[52] U.S. Cl. ..... 211/13; 206/511; 206/821; 211/126; 248/DIG. 2

[51] Int. Cl.[2] ..... A47F 7/02

[58] Field of Search ..... 211/13, 126, 177; 248/DIG. 2; 206/503, 511, 512, 821; 108/53, 64, 91; 220/23.6

[56] References Cited

UNITED STATES PATENTS

| | | | |
|---|---|---|---|
| 1,957,153 | 5/1934 | Smiley | 206/821 X |
| 2,349,385 | 5/1944 | Snelling | 211/126 |
| 2,916,239 | 12/1959 | Stopps | 108/53 |
| 3,407,961 | 10/1968 | Box | 206/511 |
| 3,584,744 | 6/1971 | Ettlinger | 211/126 X |

*Primary Examiner*—Roy D. Frazier
*Assistant Examiner*—Robert W. Gibson, Jr.
*Attorney, Agent, or Firm*—Oltman and Flynn

[57] ABSTRACT

Each retainer consists of a thin walled plastic molding generally of elongated rectangular shape having an elongated open top and partially open front and including a combination vertical plug and socket at diagonally positioned opposite rear corners for simple friction assembly in superposed stacked relation, with each stack capable of end junctions for forming simple angular, triangular, rectangular and other polygonal formations of stacks for retaining pluralities of relatively small articles, such as spectacles, notions or other packaged goods.

10 Claims, 9 Drawing Figures

ARTICLE RETAINER FOR STACKED ASSEMBLY

This invention relates in general to the assembly of multiples of retainers to display and advertise relatively small devices and may be selectively assembled into various sizes and shapes for displaying like or different articles viewable from one or several directions.

A principal object of the invention provides for the simple manual assembly of horizontally spaced unit retainers into vertical, triangular, rectangular or other polygonal forms of stacks of various heights of like retainers for displaying a like or a variety of articles for sale and easily removable from each retainer.

Prior retainers for displaying articles are usually non-adjustable relatively fragile printed paper-board and limited to one or a small number of articles and subject to expensive replacement when the retainer or the contents thereof are defaced or damaged, which is in contrast to the simple widely variable assembly which protects the contents thereof and is a distinct advantage over prior retainers.

A further advantage resides in the simplicity of rapid hand assembly without the use of tools or adhesives.

These and other objects and advantages in one embodiment of the invention are described and shown in the following specification and drawings, in which.

Figure 4:
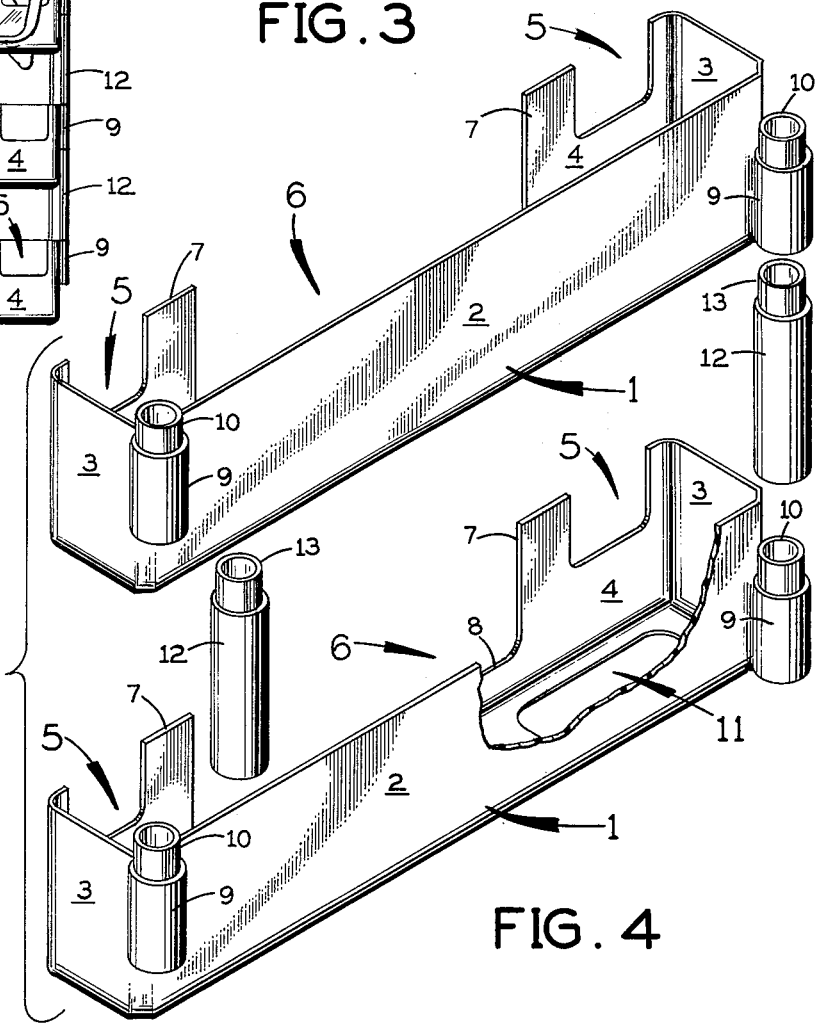
FIG. 4 is an enlarged exploded perspective view of two lower receptacles shown in FIG. 1 including a displaced view of the pivotal spacers, with a portion of one retainer broken away showing one or two spaced apertures in the bottom of each retainer.

Referring to FIG. 4, each typical retainer 1 is die molded of plastic material such as one of the well known vinyl compounds and has a wall thickness of substantially fifteen to twenty thousands of an inch. Each retainer 1 has a rear wall 2 and opposite ends 3 of uniform height and a portion of the front side 4 has a small rectangular opening 5—5 in opposite end portions of the vertical front with a large opening 6 between a pair of small upright guard members 7—7 with a small marginal lower vertical portion 8 integral with the bottom of the retainer.

Viewed from the rear, the upper portion of the left hand corner of the retainer includes a hollow cylindrical vertical socket 9 integral with the retainer and having a predetermined smaller outside diameter upper plug 10, extending upward from a shoulder. A like socket 9 and plug 10 is integral with the lower portion of the right hand corner of the retainer.

Figure 1:
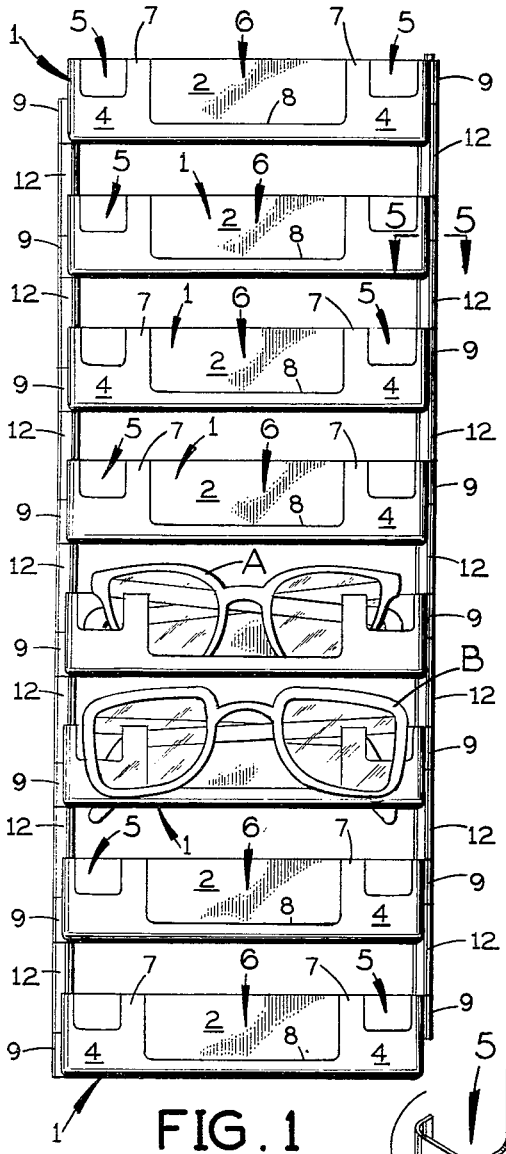
FIG. 1 illustrates in reduced scale eight superposed spaced retainers stacked for retaining and displaying like or a variety of spectacles.
Figure 2:
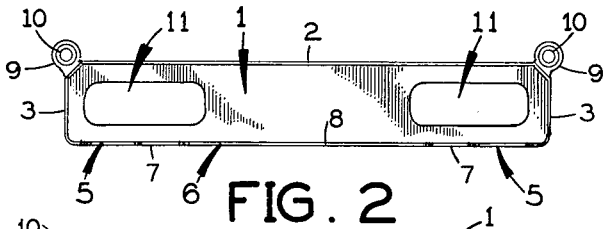
FIG. 2 is an enlarged top plan view of the uppermost retainer shown in FIG. 1.
Figure 3:
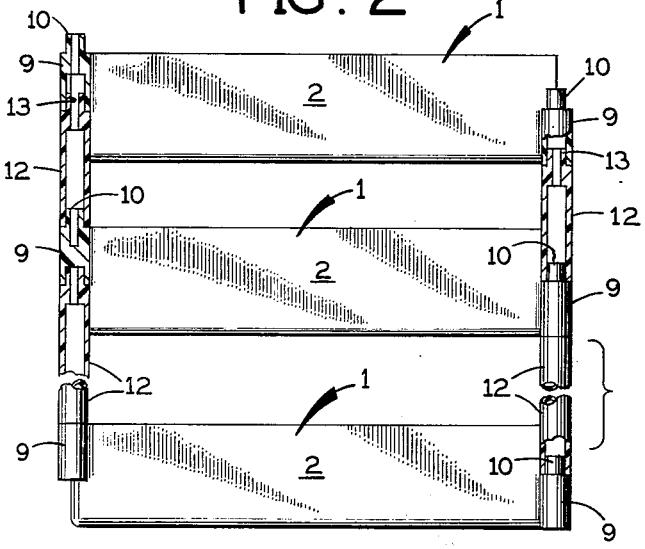
FIG. 3 is an enlarged rear elevation of the lowermost three retainers in FIG. 1 secured together with two pair of cylindrical pivotal spacers.
Figure 5:
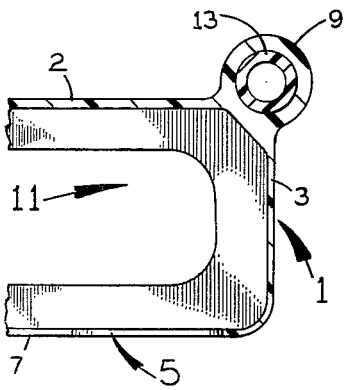
FIG. 5 is a fragmentary top cross sectional plan view of a retainer, taken through section line 5—5, FIG. 1.

The bottom of the retainer is horizontal and includes a pair of spaced apertures 11—11, shown in FIGS. 1 and 5, for partial projection of spectacle lenses.

A pair of hollow cylindrical spacers 12—12 each have a bore in one end thereof for a snug sliding fit onto each plug 10. An upper extension plug 13, like each plug 10, is adapted for snug frictional fit in the lower bore in each socket 9.

It is to be noted that each hollow plastic molded spacer 12—12 may be in pairs of predetermined length for predetermined retainer spacing and will snugly receive the plug 10 of each socket 9 on each side of each retainer.

Figure 6:
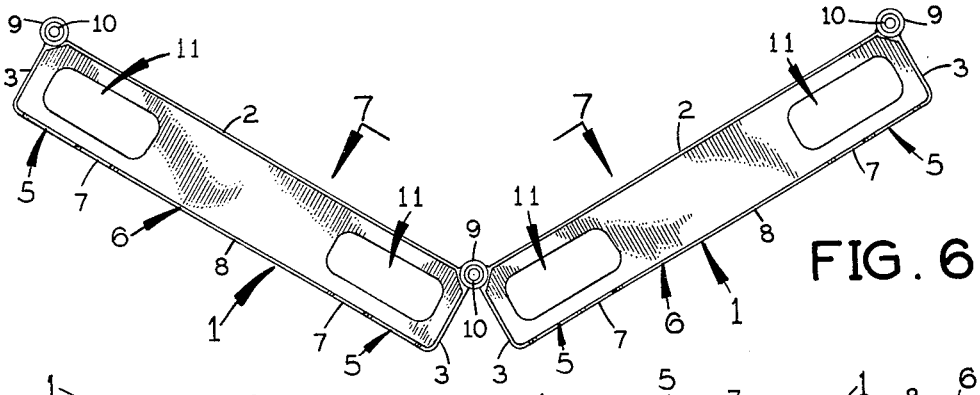
FIG. 6 is a top plan view of two stacks of retainers hinged together at opposite ends thereof.
Figure 7:
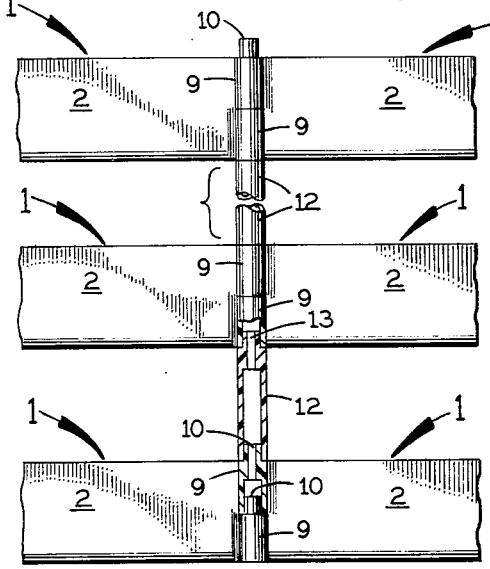
FIG. 7 is a fragmentary inside elevation of six of the hinged stacks, shown in FIG. 6, secured by two pivotal cylindrical spacers with a portion of one thereof broken away.

FIGS. 6 and 7 clearly illustrate two stacks of like receptacles 1 that are pivoted for rotation about a plurality of spacers 12 engaged with sockets 9 by virtue of plug 10 of the socket and plugs 13 of the spacers. It is to be noted that the differences in spacing of the retainers may be required for different articles to be held therein.

The fragmentary view, FIG. 7, shows a different spacing between retainers as a result of the use of corresponding differences in the length of the spacers 12.

Figure 8:
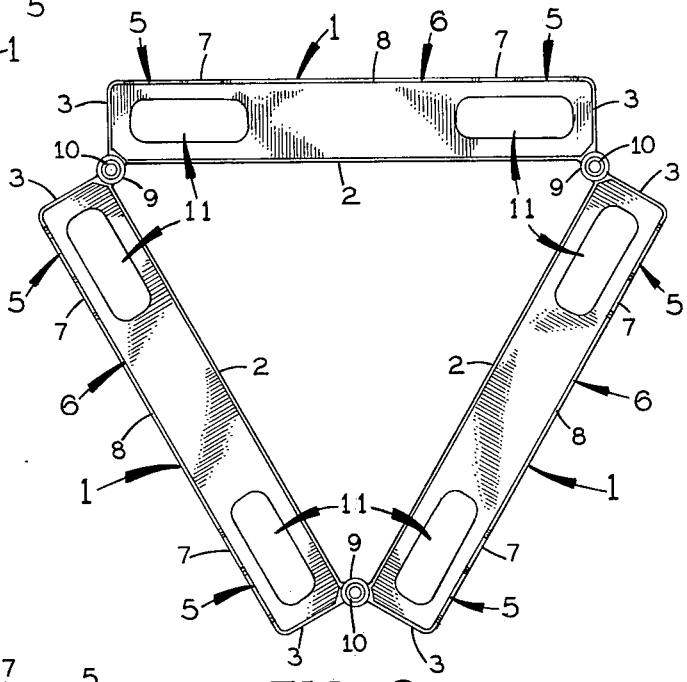
FIG. 8 is a top plan view of three stacks of retainers secured by pivotal spacers into fixed triangular cross section.

FIG. 8 is a top view of three like stacks, all pivoted together by the use of spacers of predetermined length for obtaining desired spacing between retainers.

Figure 9:
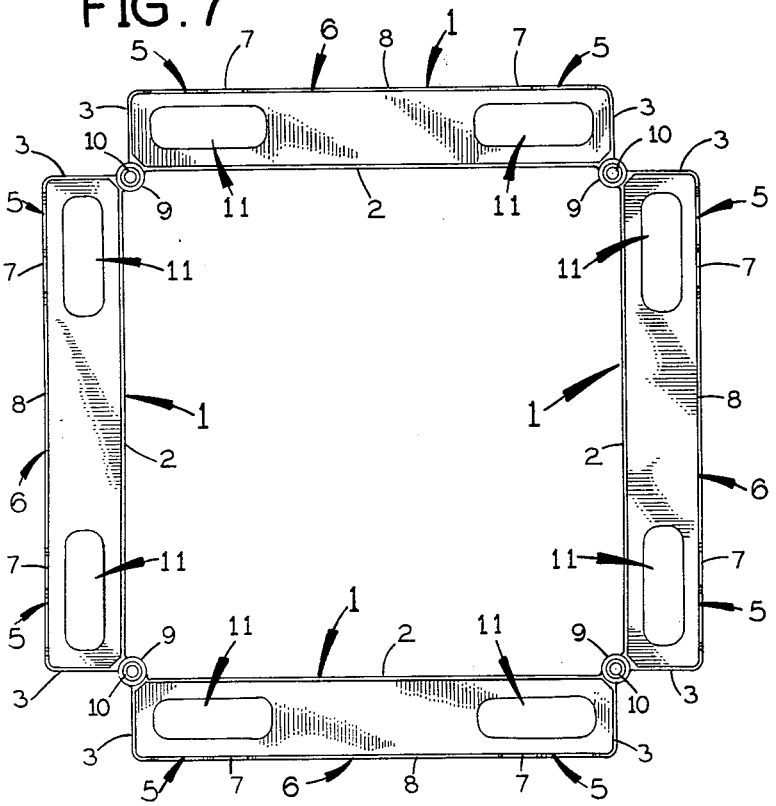
FIG. 9 is a plan view of four stacks of retainers pivotally secured by pivotal spacers into a fixed rectangular cross section.

FIG. 9 illustrates four stacks of retainers pivotally secured with spacers between each set of four retainers. It is apparent that other polygons can be assembled in a similar manner to accomplish both increased capacity and shapes best suited for final use.

It is to be understood that certain modifications in construction are intended to come within the scope and teachings of the above specification.

Having described my invention, I claim:

1. An article retainer for stacked assembly with a plurality of identical other article retainers, said article retainer comprising:

a bottom and an upstanding rear wall which extends up from said bottom;

a first socket rigidly attached to said rear wall at one end of the latter, said first socket extending vertically for substantially less than full height of said rear wall and terminating at its lower end in a downwardly-facing shoulder which is spaced a predetermined distance above said bottom;

a second socket rigidly attached to said rear wall at the opposite end of the latter, said second socket extending vertically for substantially less than the full height of said rear wall and terminating at its upper end in an upwardly-facing shoulder which is spaced above said bottom by substantially said predetermined distance;

one of said sockets having a vertical recess therein which is open at said shoulder on said one socket;

and a post rigidly attached to the other of said sockets and projecting vertically beyond the respective shoulder thereon, said post being shaped and dimensioned to be slidably insertable into said recess in said one socket on an adjoining identical article carrier to releasably interlock the two article carriers at the same level with their respective downwardly and upwardly-facing shoulders substantially contiguous to each other.

2. An article retainer according to claim 1, wherein said first socket extends vertically for substantially the upper half of said rear wall, and said second socket extends vertically for substantially the lower half of said rear wall.

3. An article retainer according to claim 2, wherein said recess is in said first socket and extends up from the latter's downwardly-facing shoulder, and said post is rigidly attached to said second socket and extends up from the latter's upwardly-facing shoulder.

4. An article retainer according to claim 3, and further comprising an additional post rigidly attached to the upper end of said first socket and extending vertically therefrom upward beyond the top of said rear wall.

5. An article retainer according to claim 1, wherein said recess is in said first socket and extends up from the latter's downwardly-facing shoulder, and said post is rigidly attached to said second socket and extends up from the latter's upwardly-facing shoulder.

6. An article retainer according to claim 1, wherein said recess and said post are of complementary cylindrical cross-section to enable two such adjoining, interconnected article retainers to be arranged at various angular positions with respect to each other at the same level.

7. An article retainer according to claim 1, and further comprising a front wall extending up from said bottom and spaced in front of said rear wall, said front wall having:

a deep, central, substantially rectangular, horizontally elongated recess which is open at the top of said front wall and extends down almost to said bottom;

and two shallower, substantially rectangular recesses which are located respectively on opposite sides of said central recess and are open at the top of said front wall and terminate approximately half-way down the front wall.

8. An article retainer according to claim 7, wherein said bottom is a substantially flat, horizontal wall with a pair of openings therein extending respectively on opposite sides of said central recess in the front wall.

9. An article retainer according to claim 8, wherein:

siad first socket extends vertically for substantially the upper half of said rear wall;

said recess is in said first socket and is open at the bottom of said first socket;

said second socket extends vertically for substantially the lower half of said rear wall;

and said post is rigidly attached to said second socket and extends up from the upwardly-facing shoulder on said second socket.

10. An article retainer according to claim 9, wherein said recess in said first socket and said post are of complementary cylindrical cross-section to enable two such adjoining, interconnected article carriers to be arranged at various angular positions with respect to each other at the same level.

* * * * *